US006827678B1

(12) United States Patent
Kümpel

(10) Patent No.: US 6,827,678 B1
(45) Date of Patent: Dec. 7, 2004

(54) SYSTEM FOR MAKING FOLDED BOXES FROM BLANKS

(75) Inventor: Lothar Kümpel, Düsseldorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/601,014

(22) PCT Filed: Dec. 21, 1998

(86) PCT No.: PCT/EP98/08375

§ 371 (c)(1),
(2), (4) Date: Jul. 24, 2000

(87) PCT Pub. No.: WO99/38676

PCT Pub. Date: Aug. 5, 1999

(30) Foreign Application Priority Data

Jan. 31, 1998 (DE) ..... 198 03 820

(51) Int. Cl.[7] ..... B31B 1/00

(52) U.S. Cl. ..... 493/34; 493/2; 493/51; 493/478

(58) Field of Search ..... 493/1, 2, 17, 34, 493/52, 53, 56, 128, 162, 478, 479; 700/9, 57, 144, 124, 125, 127, 117, 114

(56) References Cited

U.S. PATENT DOCUMENTS

| | | | | | |
|---|---|---|---|---|---|
| 3,742,233 | A | * | 6/1973 | Gorgens et al. | 250/231.14 |
| 3,806,012 | A | * | 4/1974 | Roch | 101/484 |
| 4,366,753 | A | * | 1/1983 | Glanz et al. | 700/125 |
| 4,405,304 | A | * | 9/1983 | Bensberg et al. | 493/478 |
| 4,498,895 | A | * | 2/1985 | White | 493/478 |
| 4,516,210 | A | * | 5/1985 | Dahlke | 493/17 |
| 4,554,777 | A | * | 11/1985 | Denk et al. | 493/478 |
| 4,565,048 | A | * | 1/1986 | Lade | 493/478 |
| 4,604,083 | A | * | 8/1986 | Barny et al. | 493/34 |
| 4,847,775 | A | | 7/1989 | Roch et al. | |
| 4,874,996 | A | * | 10/1989 | Rosenthal | 144/385 |
| 5,104,365 | A | | 4/1992 | Sone et al. | |
| 5,168,453 | A | * | 12/1992 | Nomaru et al. | 700/114 |
| 5,435,360 | A | * | 7/1995 | Mott | 144/356 |
| 5,528,487 | A | * | 6/1996 | Adachi et al. | 700/57 |
| 5,774,688 | A | * | 6/1998 | Georgitsis et al. | 700/117 |
| 5,910,090 | A | * | 6/1999 | Taute | 493/478 |
| 5,980,440 | A | * | 11/1999 | Mitman et al. | 493/128 |

FOREIGN PATENT DOCUMENTS

| | | | |
|---|---|---|---|
| DE | 2825648 | A1 * | 12/1979 |
| DE | 2946426 | A1 * | 5/1981 |
| EP | 0 481 137 | A1 | 4/1992 |
| JP | 63223507 | | 9/1988 |
| JP | 4246899 | | 9/1992 |
| JP | 6147896 | | 5/1994 |
| JP | 6-238547 | | 6/1994 |
| JP | 8127115 | | 5/1996 |

* cited by examiner

*Primary Examiner*—Louis Huynh
(74) *Attorney, Agent, or Firm*—Herbert Dubno; Andrew Wilford

(57) ABSTRACT

Known methods for producing folded containers, especially folding boxes, from blanks use folding-box gluing machines and accessory units comprising machine elements (2, 6, 10, 13) for processing and/or conveying the blanks or containers, which can be manually positioned to fit different blank sizes. Measuring devices (17) for determining the actual position of the machine elements (2, 6, 10, 13) to be positioned and a memory unit for storing the desired positions for different blank sizes are also known. To be able to support a machine adjuster in the adjustment of positions the invention provides for both the memory unit for the desired positions and each measuring device (17) for the actual positions to be connected to a computing element which calculates the differences between the desired positions and the actual positions. To each machine element (2, 6, 10, 13) to be positioned a display unit (20) connected to the corresponding computing element is assigned which displays the difference between the desired position and the actual position calculated by the corresponding computing element.

5 Claims, 1 Drawing Sheet

SYSTEM FOR MAKING FOLDED BOXES FROM BLANKS

CROSS REFERENCE TO RELATED APPLICATIONS

This application is the US national phase of PCT application PCT/EP98/08375 filed Dec. 21, 1998 with a claim to the priority of German application 19803820.8 filed Jan. 31, 1998.

FIELD OF THE INVENTION

The invention relates to a machine or accessory for making folded containers, in particular folded boxes, from blanks. The machine has machine elements for acting on and/or moving the blanks or containers which are manually positionable for different blank sizes, position sensors for determining the actual positions of the machine elements to be positioned, and a memory unit for storing the desired positions for various blank sizes.

BACKGROUND OF THE INVENTION

Folding-box gluing machines of the described type for making folded boxes from blanks have as is known at least the following working stations:

- a loader which draws the blanks to be used at high speed from a stack and feeds them individually to the following first working station,
- an applicator for adhesive, normally paste, that applies an adhesive strip to the fold tabs to be glued, and
- a folding station in which a blank part to be provided with a glue strip for producing a glue joint is bent through 180°, thus being folded.

Adjacent the folding station there is normally a so-called transfer station in which the boxes are counted, marked, and, if damaged, culled out. Thereafter there is a pressing station at whose intake an overlapping stream of folded blanks is formed which are held in the pressing station for some time under pressure so that the two blank parts of the glue joint are joined. After the folded-box gluing machine there is normally a packing apparatus in which the flat folded boxes are packed in cartons. Furthermore it is standard to provide between the loader and the adhesive applicator a so-called prebreaker in which the folded tabs are folded back and forth so that the corresponding fold lines are made soft by bending through 180°. Transport of the blanks through the individual working stations or accessories is done by conveyor belts.

In order that the machine can make containers of different shape, the individual stations have machine elements for working on and conveying the blanks that can be positioned for the various blank sizes. Such machine elements to be positioned are for example the stack walls and holding tongues of the loader, the folding elements of the folding station, and the adhesive nozzles or applicator elements of the adhesive applicator, as well as the transport belts in the individual stations or accessories. When made as an accessory the packing apparatus for the folded boxes and a so-called preloader for automatically supplying the loader have elements that must be positioned dependent on blank format. With the exception of the pressing station there are in each working station machine elements that must be repositioned with each change of blank format transversely or longitudinally to the travel direction of the blanks or even vertically.

The product literature "DIANA 05-3 The Universally Usable Folded Box Gluing Machine" of applicant describes such a folded box gluing machine that has digital position indicators for the machine elements to be positioned. There is an electronic data book serving as memory unit for the desired positions of the various types of boxes which displays on a screen the desired position to the machine adjuster for manual setting. The folded-box gluing machine is also provided with an adjusting mechanism which is connected to the computer to directly and automatically set the machine elements for format by means of attached drive motors. This system is however very expensive.

OBJECT OF THE INVENTION

The object of the invention is to inexpensively improve a machine or accessory of the described type where the machine elements are manually positioned so that the machine adjuster can manually rapidly set positions with little likelihood of error.

This object is achieved according to the invention in that both the memory unit for the desired positions as well as each position sensor for the respective actual position are connected with a computer which calculates the difference between the respective desired position and the respective actual position, and each machine element to be positioned is associated with a respective display which is connected to the computer and which displays graphically or numerically the difference between the respective actual position and the respective desired position calculated by the computer.

The solution of the invention has the advantage that the machine adjuster when resetting position is shown the amount of repositioning needed to the desired position and preferably also the direction of positioning movement right there where the adjustment must be made. When the difference is equal to zero the desired position has been reached. The adjuster does not need to read the desired position from a remote screen and make a note of it or remember it so that he can set the corresponding machine element to the right position. With the large number of machine elements to be positioned in a folded-box gluing machine the remembering and transferring of desired positions creates the danger of errors and is also time-consuming, e.g. if the adjuster makes a printout of the values.

The solution according to the invention has the further advantage that it contains elements that can all be used when refitting the machine to fully automatic operation.

BRIEF DESCRIPTION OF THE DRAWING

The drawing serves for describing the invention with reference to a schematically illustrated embodiment.

SPECIFIC DESCRIPTION

In the transport direction (from right to left) the machine starts with a loader 1 which draws the blanks to be worked with high speed from a stack and feeds them individually to the downstream working stations. The loader 1 has a stack support on which the blanks are set in a stack and which is defined by a output conveyor formed as a belt conveyor that engages the bottom of the stack. On its output side the stack support is provided with adjustable tongues that end slightly above the output conveyor so that a gap is left open through which the blanks can be drawn individually off the bottom of the stack. Such a loader is described in German patent 2,946,426.

Figure 2:
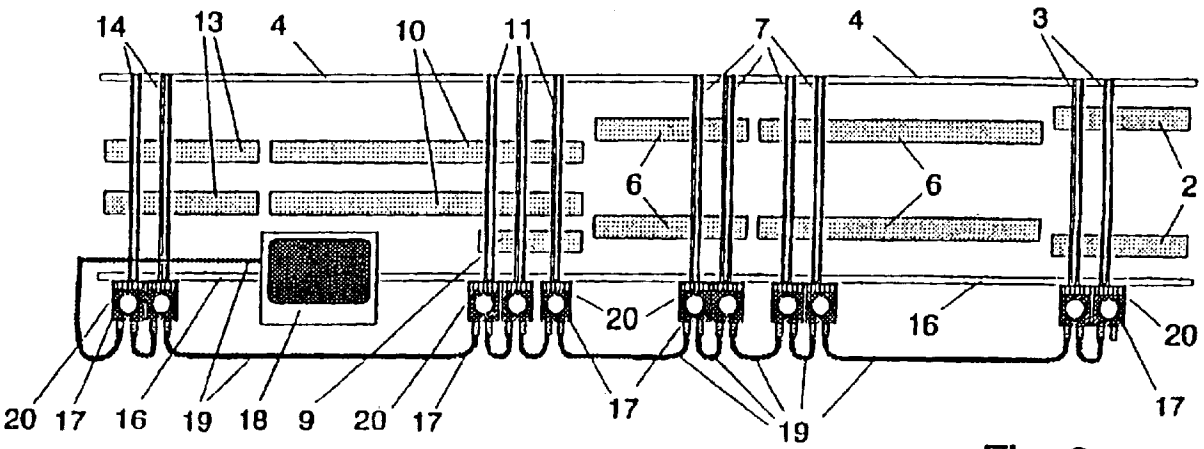
FIG. 2 schematically shows the arrangement of the elements serving for positioning.

When box format is changed, the side walls 2 of the stack support—as shown in FIG. 2—are repositioned transversely to the transport direction. They are to this end mounted on adjustment spindles 3 which are each mounted at their ends for rotation in side walls of the station.

The loader 1 is followed by a prebreaker 5 which in this embodiment works in two stages. The prebreaker 5 has folding elements 6 that fold tabs forward and back so that the corresponding longitudinal fold lines are softened by folding through 180°. Two-stage construction makes it possible to soften several fold lines. With certain box shapes glue applicators are also provided inside the prebr aker 5 in order to apply additional glue strips extending longitudinally. The folding elements 6, for example roller arms, supported folding belts, or roller rails, must be repositioned transversely like the conveyor belts leading through the prebreaker 5 when the box shape is changed. In order to facilitate such transverse positioning, these elements and the conveyor belts extending through the prebreaker—as shown in PIG. 2—are also mounted on adjustment spindles 7 that extend full width transversely with their ends rotatably mounted in the side walls 4 of the machine.

Following the prebreaker 5 as the next working station is the folding station 8 at whose upstream side is an applicator 9 for an adhesive, normally paste. The adhesive applicator 9 has extending transverse to the positioning elements glue nozzles or glue plates from which the adhesive is applied in strips to the blanks. Thereafter the fold tabs of the blanks are folded by elements 10 (folding belts, roller arms, roller rails), with the desired glue joint being formed. Even the folding elements 10 must be transversely positioned according to blank size. They are to this end, like the glue-applying elements of the adhesive applicator 9 and the conveyor belts extending through the folding station, adjustable across the width of the machine by spindles 11.

Subsequently the flat folded boxes are fed to a transfer station 12 whose conveyor belts 13 are also transversely positionable on spindles 14. In order to accommodate various box lengths the transport length of the conveyor belts 13 can also be varied in the travel direction. To this end at least the output rollers of a conveyor belt are moveable in and against the transport direction by means of a rack. In the transfer station a succession of the folded boxes is produced that subsequently is advanced to a following pressing station. In addition in the region of the transverse station 12 there are devices by means of which the boxes are counted, marked, and, if damaged, culled out.

Even these devices must if necessary be adjusted when the box shape changes transversely, longitudinally, or vertically. The pressing station has pressing elements by means of which the glue seams are held under pressure until the glue is fixed.

Figure 1:
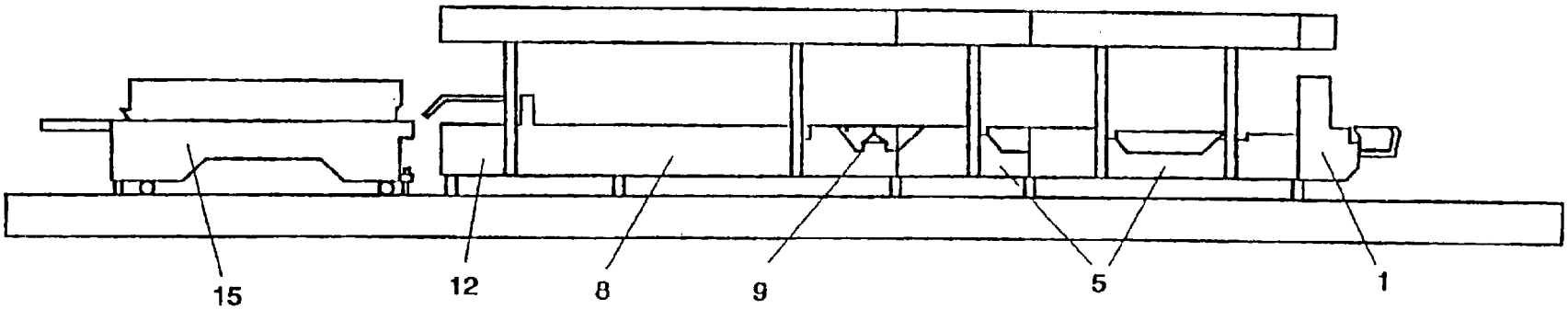
FIG. 1 shows in a schematic side view the individual stations of a folded-box gluing machine.

FIGS. 1 and 2 do not illustrate accessories that also have elements positioned transversely, longitudinally, or vertically. Such an accessory is for example a packing device following the pressing apparatus 15 and serving to pack the flat folded boxes in cartons. A particularly ideal packing device is described in German patent 2,825,648. A further additional system is for example a so-called preloader that serves for increasing the production capacity upstream of the loader. Such a preloader is described in German published application 195 35 903. It serves to feed the blanks to the stack of the loader 1 in overlapping condition.

Even these additional systems have, for receiving, working on, or advancing the blanks, machine elements that must be repositioned when the box shape changes. They therefore have additionally or even alone the elements describ d below for the box-folding machine and which must be used on for conversion to another box format.

Each adjustment spindle 3, 7, 11, and 14 projects somewhat from the side wall 16 of the respective station on the service side. Thus a service person can use an actuating tool, for instance a crank, electric wrench, or a pneumatic tool in order to rotate the adjustment spindles 3, 7, 11, and 14 and thereby change the positions of the machine elements mounted on them. On the outer side of the side wall 16 there is for each adjustment spindle 3, 7,11, and 14 a position sensor 17 for determining the actual position of the machine element to be positioned. The position sensors 17 can be of the known absolute- or relative-measurement type that produce an output signal corresponding to the position of the machine element.

Each position sensor 17 is connected with a calculating and memory unit 18 in which the actual position of the respective machine element for the various boxes is stored. Preferably the position sensors 17 are connected via a bus system 19 with the calculating and memory unit 18.

Each machine element to be positioned is associated with a display 20 that is also connected via the bus system 19 with the computing and memory unit 18. The displays 20 are each adjacent the respective machine element to be positioned so that operating personnel can read them while making adjustments. Preferably the display 20 is as shown in FIG. 2 integrated into the respective position sensor 17. The computing and memory unit 18 calculates for each machine element the difference between the stored desired value and the measured actual value of its position and transmits the difference to the respective display 20 where it is shown numerically or graphically. The adjusting personnel thus has the difference value in his view. He need merely rotate the respective spindle 3, 7, 11, or 14 until the difference is equal to zero.

Preferably the respective computer—here the calculating and memory unit 18—also determines the necessary direction of movement of the machine element, transmits it to the respective display, and displays it there. This can also be done by a corresponding graphic display, for example by a colored display, or by use of a sign.

In this embodiment the calculating and storage unit 18 holds both the data for the desired positions as well as the calculator for determining the difference between the desired positions and the actual positions. Since position sensors with integrated processors are available, such position sensors can be used to calculate the difference. In this case a separate memory unit is needed only to hold the desired positions and feed them to the respective integrated processors. This solution is particularly advantageous when retrofitting existing machines that already have a memory unit for the desired positions.

A further also preferable retrofittable embodiment has in addition to a separate memory for the desired positions, individual calculators for each measuring and display device.

Such a calculator holds the desired positions from the memory unit and the respective actual positions from the position sensors. It calculates the difference between the respective actual and desired positions and transmits the results to the respective displays.

Preferably for each machine element to be positioned there is also the possibility to display the actual position for monitoring purposes. Since each display 20 is connected with the respective position detector 17 for determining the actual position, the displays 20 are preferably also used to show the actual position, for example can be switched between the two display values. Alternatively separate displays can be provided for the actual positions of the respective machine elements. Thus each position sensor 17 can have a second display for the actual position.

What is claimed is:

1. A machine for making folded boxes from blanks, the machine comprising:

a conveyor for moving the blanks through a succession of working stations;

a respective manually positionable machine element at each of the stations for engaging the blanks;

a respective position sensor at each of the stations associated with the respective element for determining an actual position of the respective element;

a central memory located away from the working stations and holding respective desired positions for the elements;

a central computer located away from the working stations and connected to the memory and to the position sensors for calculating differences between the actual positions determined by the sensors and the respective desired positions held by the memory; and a respective local display device at each working station connected to the central computer for displaying the respective difference between the respective actual position and the respective desired position, whereby an operator of the machine can manually position the elements in accordance with the difference displayed by the local display device at ach element.

2. The improved box-making machine defined in claim 1 wherein the central computer also calculates a direction in which the elements must be displaced to move to the desired positions and the local display devices show the respective directions at the respective elements.

3. The improved box-making machine defined in claim 1, further comprising a bus system connecting the computer and memory to the sensors.

4. The improved box-making machine defined in claim 1 wherein the computer and memory are separate units.

5. In combination with a machine for making folded boxes from blanks, the machine having a conveyor for moving the blanks through a succession of working stations;

a respective manually positionable machine element at each of the stations for engaging the blanks; and a respective position sensor at each of the stations associated with the respective element for determining an actual position of the respective element; a system comprising:

a central memory located away from the working stations and holding respective desired positions for the elements;

a central computer located away from the working stations and connected to the memory and to the position sensors for calculating differences between the actual positions determined by the sensors and the respective desired positions held by the memory; and a respective local display device at each working station connected to the central computer for showing the respective difference between the respective actual position and the respective desired position, whereby an operator of the machine can manually position the elements in accordance with the difference displayed by the local display device at each element.

* * * * *